US006752267B2

(12) United States Patent
MacPherson et al.

(10) Patent No.: US 6,752,267 B2
(45) Date of Patent: Jun. 22, 2004

(54) PAINT BRUSH CASE

(76) Inventors: Murray Allan MacPherson, 3408 Utah Dr. NW., Calgary, AB (CA), T2N 4A4; Jaret Austin Parker, 2336 W. 8th Ave., Vancouver, BC (CA), V6K 2A9

( * ) Notice: Subject to any disclaimer, the term of this patent is extended or adjusted under 35 U.S.C. 154(b) by 130 days.

(21) Appl. No.: 10/152,454

(22) Filed: May 21, 2002

(65) Prior Publication Data

US 2003/0217941 A1 Nov. 27, 2003

(51) Int. Cl.[7] ..... B65D 85/00
(52) U.S. Cl. ..... 206/362
(58) Field of Search ..... 206/1.7–1.9, 209, 206/361, 362, 15.2, 15.3; 15/257.05; 211/65, 66

(56) References Cited

U.S. PATENT DOCUMENTS

| | | | | | |
|---|---|---|---|---|---|
| 137,366 | A | | 4/1873 | Sather | |
| 2,043,643 | A | * | 6/1936 | Yenne | 15/104.92 |
| 2,150,706 | A | | 3/1939 | Adams | |
| 2,270,593 | A | | 1/1942 | Kurath et al. | |
| 2,278,650 | A | | 4/1942 | Drinkwater | |
| 2,310,533 | A | | 2/1943 | Lindell | |
| 2,472,001 | A | | 5/1949 | Buhoveckby | |
| 2,479,509 | A | | 8/1949 | Pichniarczyk | |
| 4,162,005 | A | * | 7/1979 | Linger | 206/362 |
| 4,573,569 | A | * | 3/1986 | Parker | 206/1.7 |
| 4,756,405 | A | | 7/1988 | Crozier | |
| 4,802,576 | A | * | 2/1989 | Kern | 206/225 |
| 5,097,967 | A | | 3/1992 | Sica | |
| 5,318,171 | A | * | 6/1994 | Szekely | 206/1.7 |
| 5,586,653 | A | * | 12/1996 | Taveroff | 206/362 |
| 6,398,027 | B1 | * | 6/2002 | Ryu | 206/362 |

* cited by examiner

*Primary Examiner*—Jimmy G. Foster

(57) ABSTRACT

A case for storing a plurality of commercial paint brushes comprised of a hinged lid and tray. Paintbrushes are suspended in the air through the cooperation of the handle pin, which secures a single brush's lower handle by its display hole, and a forward serrated bridge of aligned recesses which support the brush at the upper handle. The brush is locked in place by the closing of the lid when syncline divots in a lid mounted press form alternating seals and apertures with the recesses of the lower bridge. Brushes are kept vertically oriented through rubber protrusions forward of the apertures. The brush is prevented from slipping off the pin anchoring the handle by a bumper which cannot be cleared by the handle when a brush is in the horizontal locked position. Dividers keep the brushes segregated and the bristles protected.

6 Claims, 5 Drawing Sheets

PAINT BRUSH CASE

FEDERALLY SPONSORED RESEARCH

Not Applicable

SEQUENCE LISTING OR PROGRAM

Not Applicable

BACKGROUND

1. Field of Invention

The paint brush case relates to the field of paintbrush containers, specifically to the way in which commercial paint brushes, which have been cleaned of paint and the like, are stored.

2. Description of Prior Art

Most, if not all modern professional-model paintbrushes, are designed to have long, productive life spans, and are purchased at considerable expense. It is logical that painters, and other users of paintbrushes, would want to take full advantage of these design qualities, and get a full return on their investment. Paintbrush manufacturers typically include a paper folder, or a plastic sleeve with the purchase of a brush, as means to maintain its form during shipping and selling. These folders and sleeves are very often not durable enough to withstand the rigors of commercial use, and quickly fall apart. Brushes with no protective cases are easily damaged by pressures that force bristles out of alignment. Crimping or splaying of bristles make fine brushwork extremely difficult, drips more likely, and are virtually impossible to repair. Brushes that are stored in liquid, or are not given opportunity to dry, are subject to rusting of their metal parts and dissolution of their binding glue. Therefore, the question of what to do with a paintbrush between uses, so that it remains in good operational condition, is a very valid one, and has been often addressed by inventors as evidenced in the prior art.

Inventors in the field of paintbrush protection and storage, have proposed numerous devices for covering the ferule and bristles in a more durable individual protective wrapper or case; other examples in the prior art teach various cases and brush boxes for keeping bristles of a plurality of brushes submerged in a solvent; and still others demonstrate devices for storing clean artist's brushes. To the knowledge of the inventor, there is not a case specifically designed to store and protect a plurality of dry, clean (free of paint and the like) commercial paint brushes in either in the prior art or commercially available.

Known prior art further includes: Albanese, U.S. Pat. No. 1,979,241; Adams, U.S. Pat. No. 2,150,706; Kurath, U.S. Pat. No. 2,479,509; Drinkwater, U.S. Pat. No. 2,278,650; Pichniarczyk U.S. Pat. No. 2,479,509; Crozier U.S. Pat. No. 4,756,405; Sica, U.S. Pat. No. 5,097,967.

OBJECTS AND ADVANTAGES

Accordingly, the present invention has a range of functionality as yet unseen in combination for the express purpose of storing and preserving paintbrushes. Objects and advantages of my invention are:

(a) to provide a method of storing commercial paint brushes indefinitely so they will retain their forms, and not be damaged in anyway by external forces;

(b) to provide a method of transporting several paint brushes more easily between locations;

(c) to provide a method of organizing paint brushes so they can be easily identified;

(d) to provide a method of storing paint brushes so they can be easily and individually accessed;

(e) to provide a storage environment where clean, wet paintbrushes may be allowed to dry without threat to their form;

(f) to provide a single container for storing commercial paintbrushes of varying dimensions and styles;

(g) to provide a method of storing paint brushes that helps prevent the loss of individual paintbrushes through misplacement;

(h) to provide a means of storing, and protecting paint brushes in a case that is very easy to use;

(i) to provide a means of storing paintbrushes that makes economical use of space;

(j) to provide a means of storing paintbrushes where the mechanism that anchors the brush is straightforward and reliable;

(k) to provide a method of protecting commercial paintbrushes during transport so they will retain their forms and not be damaged in any way.

SUMMARY

The above mentioned objects and related objects in accordance with the present invention, are accomplished through a lower tray, connected by hinges to a lid in such a way that when closed a self-contained box is defined. The lower tray is characterized by a series of horizontal pins mounted perpendicularly to supports, and are vertically and horizontally aligned with individual recesses in a bridge that laterally bisects the lower tray adjacent to the pins. The lower tray is divided longitudinally ahead of the lateral divider, into protective compartments to contain bristles and the ferule of paintbrushes. The lid is likewise bisected by a nearly congruent lateral press, in which syncline embrasures are aligned in such a way that when the lid is in the closed position, the embrasures form alternating apertures and seals with the recesses of the lateral bridge of the tray. Bumpers near the pins and on the longitudinal dividers vertically align the brushes and keep them in place. Further advantages of this invention, both to its construction and mode of operation will be readily appreciated as the same becomes better understood by reference to the following detailed description when considered in connection with the accompanying drawings.

BRIEF DESCRIPTION OF THE DRAWINGS

The drawings represent a particular embodiment of the invention in a preferred form.

Figure 1:
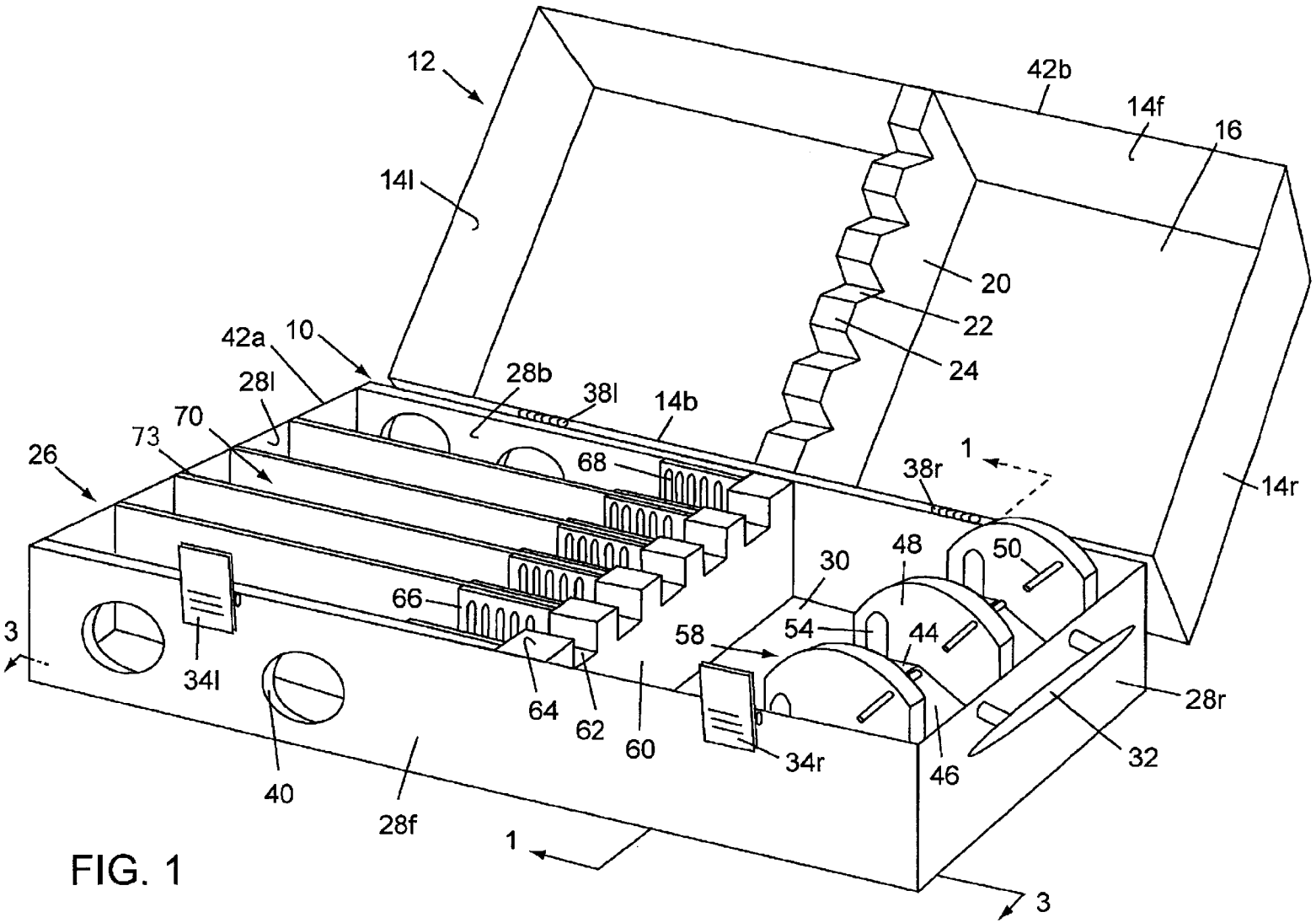
FIG. 1 is a perspective view of a paintbrush case in the open position.

LIST OF REFERENCE NUMERALS:

10 paint brush case
12 lid
14*l* lid wall left
14*b* lid wall back
14*r* lid wall right
14*f* lid wall front
16 ceiling
20 press
22 embrasure
24 upper seal
26 tray
28*l* case wall left
28*b* case wall back
28*r* case wall right
28*f* case wall front
30 floor
32 case handle
34*l* buckle left
34*r* buckle right
38*l* hinge left
38*r* hinge right
40 window
42*a* tray seal
42*b* lid seal
44 bumper platform
46 access ramp
48 anchor support
50 anchor pin
54 pin bumper
58 anchor array
60 bridge
62 recess
64 lower seal
66 ferule trap
68 ferule bumper
70 divider
72 bristle compartment
73 fence
74 aperture
76 display hole
80 paintbrush
82 bristles
84 ferule
86 paintbrush handle

DETAILED DESCRIPTION

In the drawings, closely related figures have the same number but different alphabetical suffixes. Also like numerals designate like parts throughout the figures. Also, multiple incidences of identical parts in single figures are only identified once.

Describing more particularly the specific construction of the embodiment of the invention illustrated in FIG. 1, a paint brush case 10 is in the present instance, but not necessarily rectangular, being formed by a hinged lid 12 and a tray 26, both being of very similar dimension. It may be equipped as shown with buckles 34*r*, 34*l*, and a case handle 32. The case 10 is preferably made of resilient, thermoplastic material such as polypropylene or the like, and is preferably constructed by, though is not limited to, plastic injection molding.

FIG. 1 shows a perspective view of the open paintbrush case 10, showing a left hinge 38*l* and right hinge 38*r* connecting the lid 12 with the tray 26. The interior cavity of the lid 12 is defined by 2 congruent parallel lid side walls right and left, 14*r* 14*l* respectively, joined at right angles to a lid back wall 14*b* which is congruent with a parallel lid front wall 14*f*. A ceiling 16 joins with right angles at its edges with the lid walls 14*r*, 14*l*, 14*b*, 14*f*. An upper case seal 42*b* is a concentric lip formed by the linear edges of the contiguous walls.

Figure 3:
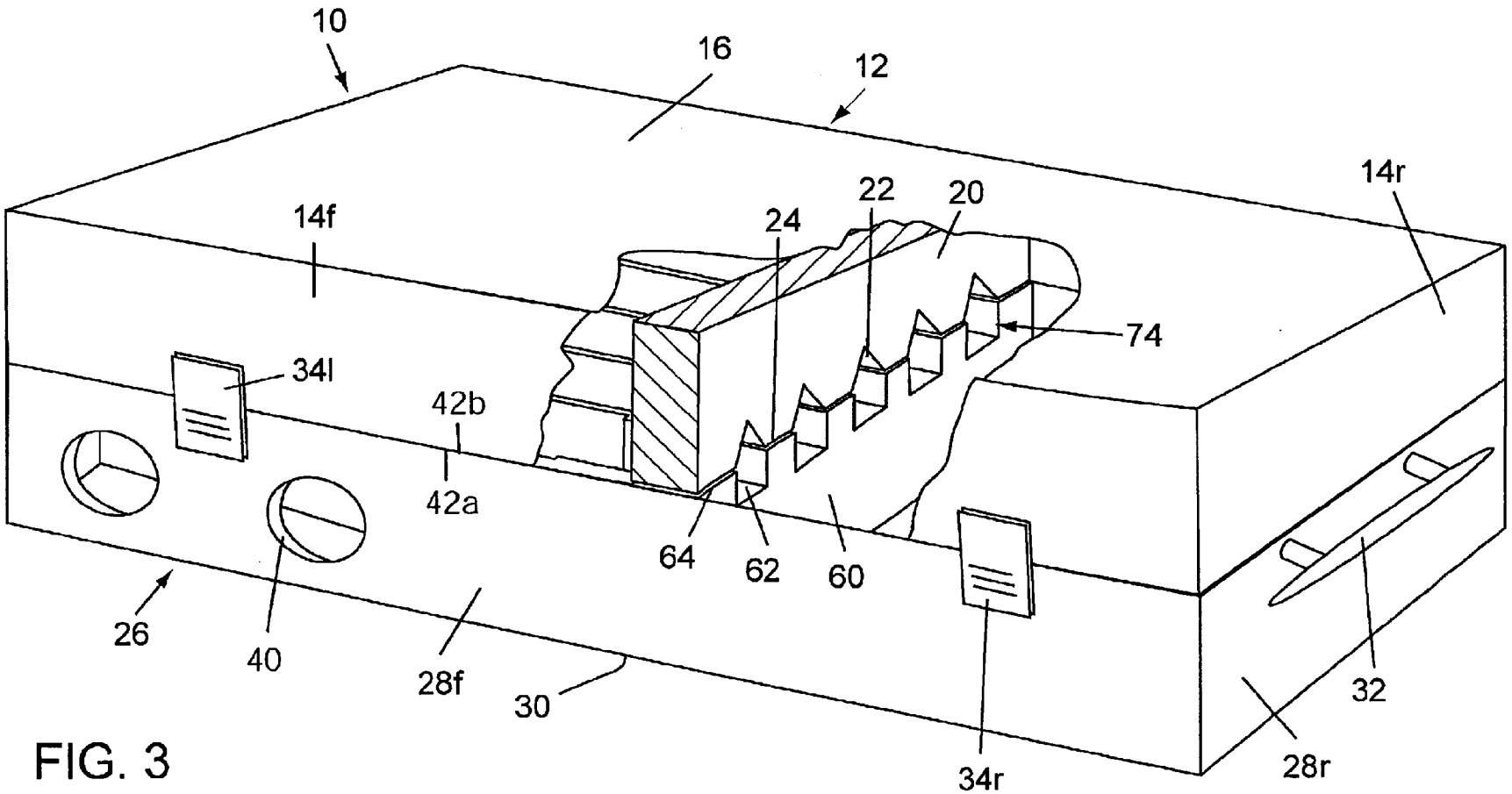
FIG. 3 is a perspective view of the paintbrush case from FIG. 1 in the fully closed position with a partial sectional showing the internal coupling of the two halves.

FIG. 1 further shows that the interior cavity of the tray 26 is similarly defined by 2 congruent parallel side case walls, left and right, 28*l* and 28*r* respectively, joined at right angles to a case back wall 28*b* which is congruent with a parallel front case wall 28*f*. A floor 30 joins at right angles to the case walls 28*l*, 28*r*, 28*f*, 28*b*. A concentric lower case seal 42*a* is formed by the linear edges of the contiguous walls. Case wall back 14*b* and case wall front 14*f* are also characterized by a plurality of windows 40. Each window 40 is circular in shape and is cut out of the case walls front and back, 14*f* and 14*b* respectively, to facilitate air flow over the paintbrush bristles. The tray 26 and lid 12 are constructed, aligned and hinged complimentary to each other so that in the closed condition thereof, they cooperate to form a closed container, as shown in FIG. 3.

FIG. 1 further reveals that connected at right angles between lid wall front 14*f* and lid wall back 14*b*, and likewise connected perpendicularly to the ceiling 16, is a press 20. The press 20 laterally traverses the lid 20, effectively dividing the interior cavity of the lid 12 into two compartments. The side of the press 20 which runs parallel to the ceiling 16, and which has no point of attachment in the open position, is characterized by a series of embrasures 22, alternating with a series of planar upper seals 24. Each embrasure 22 is defined by two obtuse planes that terminate at their intersection so that a series of inverse "V" shapes are cut out of the press 20. Each instance of the embrasure 22 occurs between instances of the upper seal 24. Each upper seal 24 is comprised of a planar surface, oriented parallel with the planer surface of the ceiling 16 and is separated by like instances of the embrasure 22. Just as lid wall front 14*f* and lid wall rear 14*r* delimit the press 20, so do they designate the endpoints of the polar incidences of the upper seal 24.

Figure 2A:
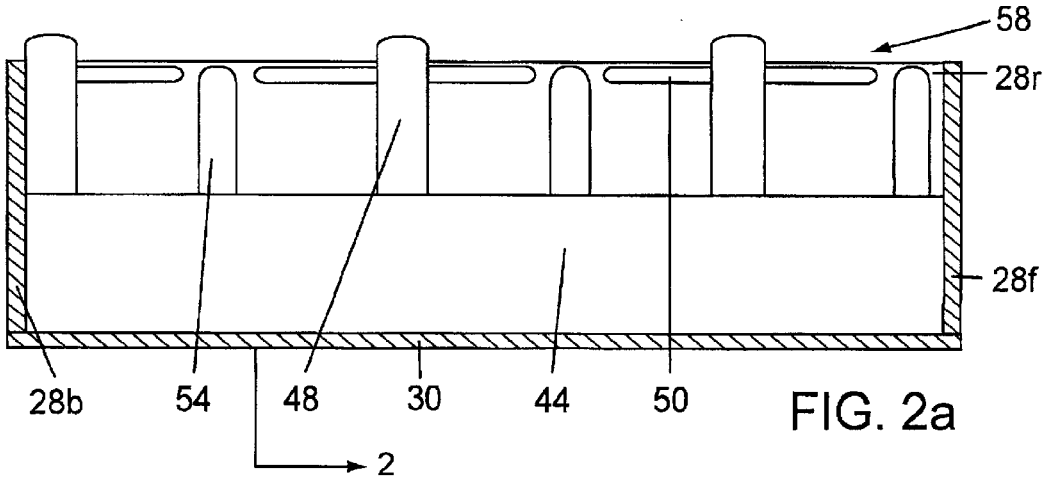
FIG. 2*a* is a sectional enlargement in plan view along the line 1—1 of FIG. 1.
Figure 2B:
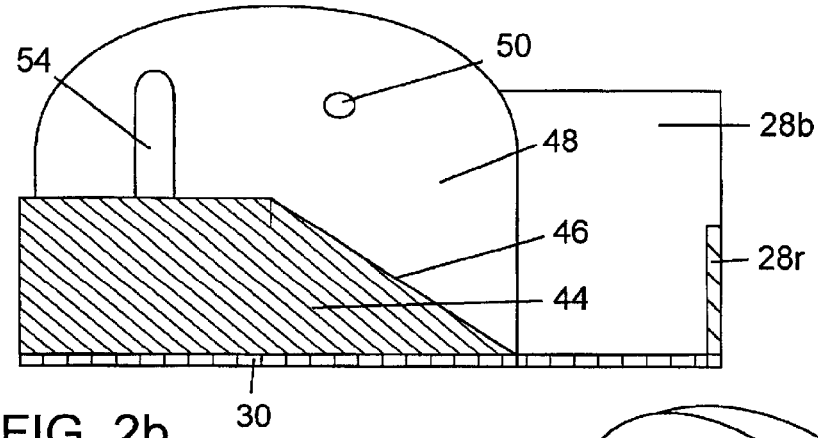
FIG. 2*b* is a sectional detail in orthographic view taken along line 2—2 of FIG. 2*a*.

Referring now to FIG. 2*a*, traversing the case 26 from case wall rear 28*r* to case wall front 28*f*, and connected perpendicularly to same, as well as connected perpendicularly to case floor 30 is an anchor array 58. The anchor array 58 is comprised of a bumper platform 44, a series of slot bumpers 54, a series of anchor supports 48, and a series of pin anchors for supporting a plurality of paintbrushes. The bumper platform 44 extends the full width of the tray 26, near to but not touching case wall right 28*r*. The bumper platform 44 is attached to the case wall back 28*b* and case wall front 28*f* and to the floor 30. FIG. 2*b* shows the bumper platform 44 is trapezoidal in shape, where the upper surface lies parallel to the floor 30. The only side not at right angles with the others is an access ramp 46, which rises from the floor 30 at an acute angle.

Figure 4:
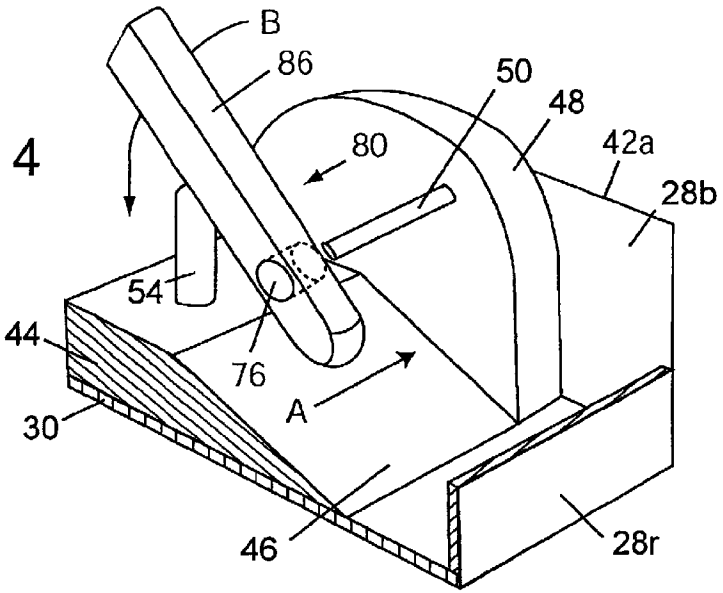
FIG. 4 is a similar view to FIG. 2*c* except with a paintbrush fragment illustrating step one and two in the operation of the invention.

Protruding from the bumper platform 44 and the access ramp 46 is the anchor support 48. The anchor support 48 rises perpendicularly from the bumper platform 44, and is characterized by two symmetrical parallel planes, and from each plane emanates the anchor pin 50. The anchor pin 50 protrudes at a right angle from the plane of the anchor support 48, and is positioned over the access ramp 44, at such a distance there from as to accommodate the handle end of a typical commercial paintbrush. The anchor pin 50 is cylindrical in shape and its length and circumference are such that it may secure a standard commercial paintbrush, as illustrated in FIG. 4. Each plane of the anchor support 48 is designed to accommodate a single brush.

Figure 2C:
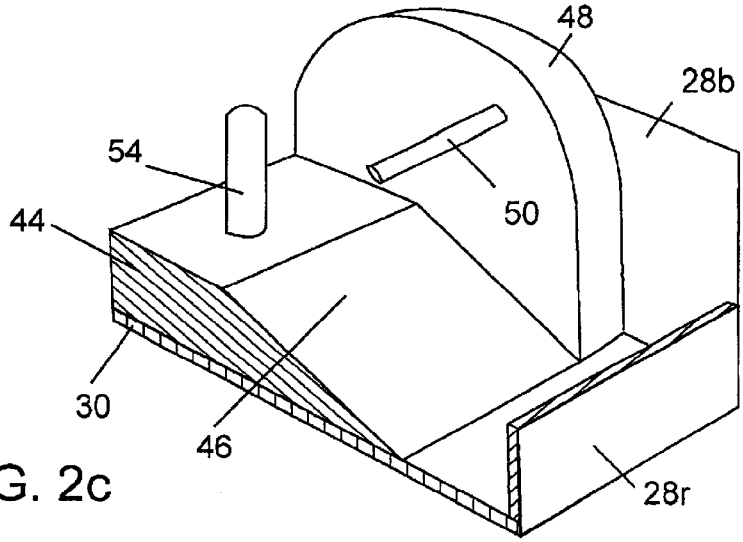
FIG. 2*c* is similar to FIG. 2*b* but in perspective view.

Referring specifically to FIG. 2*c*, anchor support 48 elements generally have two planes except for that instance designated to accommodate the final brush in a case 10 configured to store an odd number of brushes. Here the case wall back 28*b* forms the second plane, and the anchor support 48 would be able to accommodate only one brush. Instances of the anchor support 48 are positioned on the bumper platform 44 at distances from each other so that when bearing an anchor pin 50 of a length sufficient to secure a standard commercial paintbrush, there is enough space for a standard commercial paintbrush to pass between the two facing anchor pins 50, as can be seen in FIG. 2*a*.

Additionally, the bumper platform 44 supports a pin bumper 54. The pin bumper 54 in the present embodiment is cylindrical in shape and extends upwards from the upper plane of the bumper platform 44. The pin bumper 54 must be short enough to allow brush handles to easily access the anchor pin 50 when being placed in the case 10 or taken out thereof, but must be tall enough to keep any brush at rest in the case 10 from laterally slipping off the anchor pin 50. In the preferred embodiment each instance of the pin bumper 54 is alike, and they are positioned on the bumper platform 44 between each incident of the anchor support 48.

Referring again to FIG. 1, spanning the full width of the tray 26 is a bridge 60. The bridge 60 is attached to case wall back 28*b*, case wall front 28*f*, and the case floor 30, with a similar alignment in the tray 26, as the press 20 has in the lid 12. The bridge 60 is characterized by a flat, elevated lower seal 64, and a series of square-shaped recesses 64. The recesses are cut out to a depth and width that they can accommodate a wide range of paintbrush handle styles, and secure them with reasonable tightness. The lower seals 64 separate each instance of the recess 62.

Referring to FIG. 3 now, the planar dimensions of the lower seal 64 are substantially the same as those of the upper seal 24 and have the same alignment, so that when the case 10 is in the closed position, each instance of the upper seal 24 will come to rest in an adjacent position to the corresponding instance of the lower seal 64. Additionally, each instance of the embrasure 22 comes to rest in line with a corresponding instance of the recess 62, thereby creating a series of uniform apertures 74. In the preferred embodiment the bridge 60 and the press 20 are of such dimension that when the case 10 is in the closed position, lower seal 64 forms a reasonable seal with upper seal 24.

Figure 7:
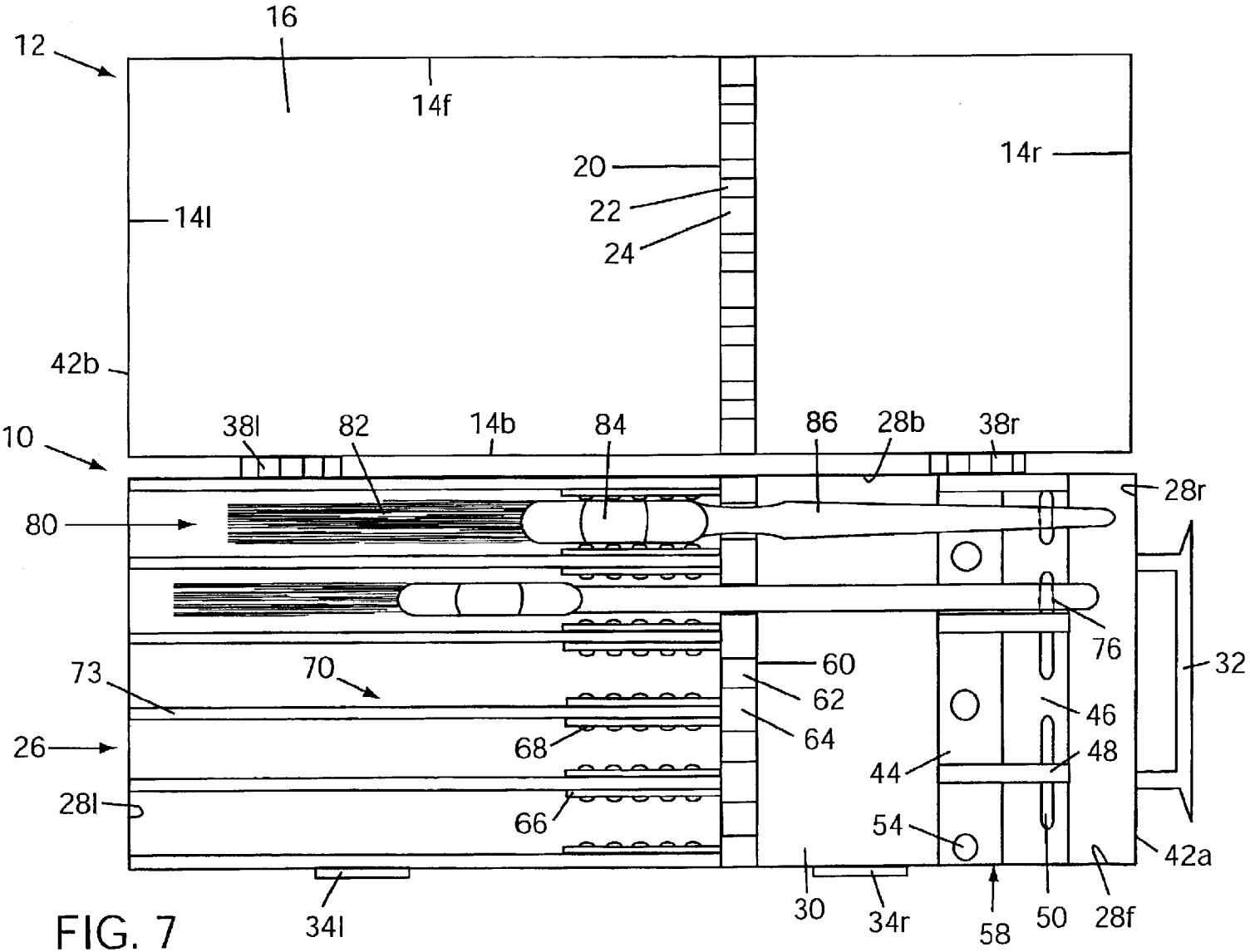
FIG. 7 is a plan view from above of the paintbrush case from FIG. 1 disposed in the fully open position, showing stored paintbrushes.

As seen most clearly in FIG. 7, each instance of the recess 62 will necessarily be in alignment with a corresponding instance of the handle pin 50 in order for the case 10 to be functional. In the same way, each instance the lower seal 64 is aligned with alternating instances of either the pin bumper 54, or the anchor support 48, there by creating conduits to accommodate stored paintbrushes.

Referring again to FIG. 1, emanating from each instance of the lower seal 64 is a divider 70. The divider 70 is comprised of a ferrule trap 66, a ferule grip 68, and a fence 73. The divider 70 is attached to the bridge 60 and the case floor 30 at right angles, and extends towards case wall left 28*l* on a line parallel to case wall front 28*f* and case wall back 28*b*. Each divider 70 is attached to the bridge 60 only at the lower seal 64, and is less wide than the lateral planar dimension of the lower seal 64. Each instance of the divider 70 is parallel to each other like instance, and between each two instances is an empty bristle compartment 72. The ferule trap 66 is that part of the divider 70 which attaches to the bridge 60, and is characterized by a lateral dimension greater than the divider 70, but less than that of the lower seal 64. The dimensions of the ferule trap 66 are such that the ferule of a standard commercial paintbrush may pass closely between two adjacent instances. The ferule trap 66 supports the ferrule grip 68, which is attached in a vertical orientation. The ferule grip 68 is made of highly durable rubber or some other substance with similar flexible properties. Each instance of the ferule trap 66 supports a plurality of substantially identical instances of the ferule grip 68, which protrudes from the ferule trap 66 in such a way that it may contact the ferule of a stored paintbrush, but not arrest its descent. In the present embodiment the height of the dividers is the same as the ferule trap 66. This height is sufficient that each brush laid to rest in the case 10, is effectively segregated from any other brush, but is not so high as to interfere with the closing of the lid 12.

OPERATION

Referring to FIG. 4, the manner of using the paintbrush case 10 to store a standard commercial paintbrush 80 should be evident to those skilled in the field. Virtually every mass produced commercial paintbrush 80 has a display hole 76 through the end of its handle so that it may be displayed on a hook or the like while for sale. Approaching the open case 10 with at least one unoccupied anchor pin 50, the end of the brush handle 86 is positioned over the access ramp 46, and moved to such an angle that the anchor pin 50 may be inserted through the display hole 76, without progress being impeded by either the brush handle 86 striking the pin bumper 54, or the end of the brush handle 86 contacting the access ramp 46, the floor 30 or the case wall right 28*r*. Once the end of the anchor pin 50 has been inserted through the display hole 76, the paintbrush 80 can be maneuvered the full width of the anchor pin 50, so that is flush with the anchor support 48, as illustrated by arrow A. Then the paintbrush 80 may be rotated by the secured end of the handle 86 as illustrated by arrow B.

Figure 5:
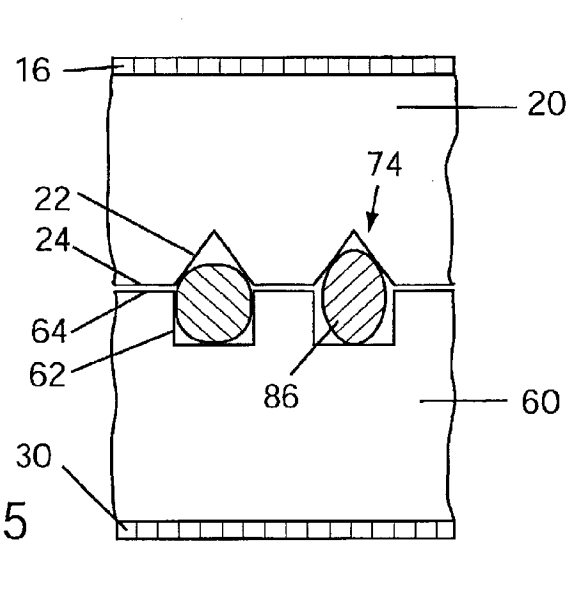
FIG. 5 is a sectional enlargement in plan view showing the internal cooperation of the two halves in securing paintbrushes.
Figure 6:
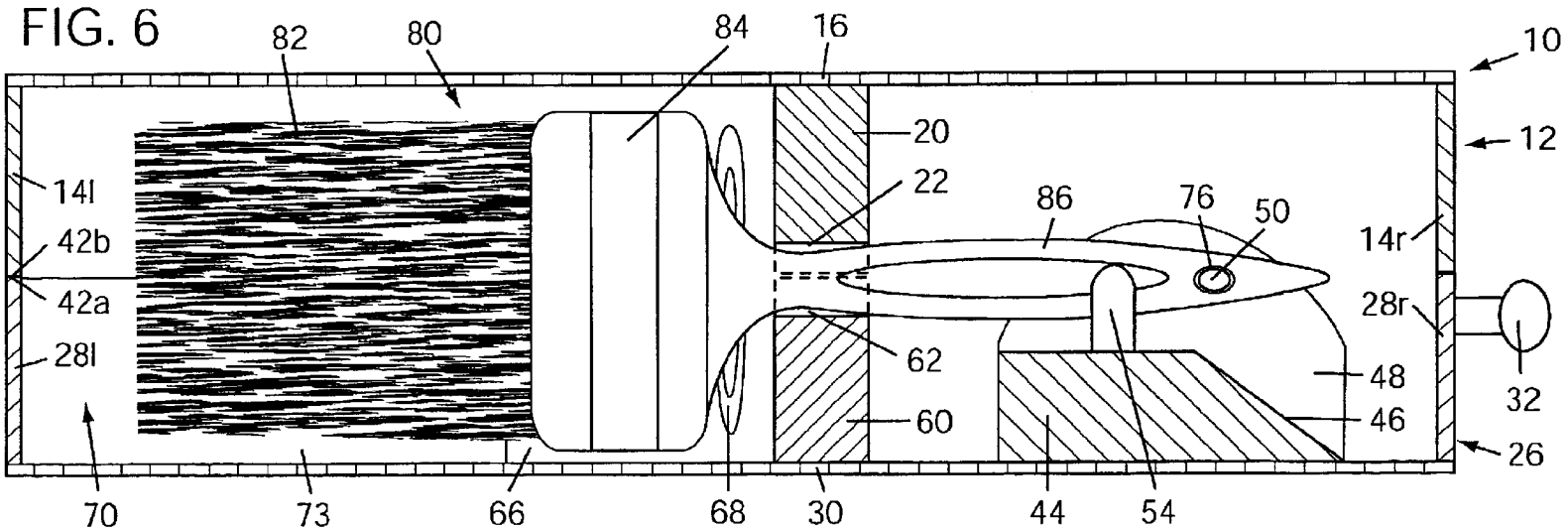
FIG. 6 is a sectional enlargement in plan view along line 3—3 of FIG. 1, showing the case from FIG. 1 in the fully closed position, and a paintbrush held securely in place.

Looking at FIG. 6, when the paintbrush 80 is flush with an anchor support 48, the paintbrush 80 will be automatically aligned with one of the recesses 62 in the bridge 60, and bristle compartments 72, corresponding to the present anchor pin 50. After all brushes 80 have been likewise placed in their respective recesses 62, the operation is simply completed by closing the lid 12. Closing the lid 12 positions the embrasures 22 over the recesses 62 in such a way that the handle 86 of the brush 80 is held securely, and that any vertical movement of the handle 86 is kept to a minimum, as demonstrated in FIG. 5.

In FIG. 7, likewise the width of the recess 62 ensures a minimum of horizontal movement, but for those brushes that have thinner handles and wider ferules, the ferule grip 68 works to stabilize the brush in a vertical position, to prevent the bristles 82 from contacting any part of the case 10. The anchor pin 50 ensures that there is no longitudinal motion, and the pin bumper 54 prevents the brush 80 from slipping off the handle anchor 50 while it is in the lowered position. The dividers 70 keep each brush separate from the next, and keep the bristles 82 of the brushes 80 in good alignment. Thus, the bristles 82 of the brush 80 are suspended, the brush

80 is immobile, and the brush 80 remains secure and protected regardless of the position of the case 10. A brush 80 is removed from the case 10 simply by opening the lid 12, rotating the brush 80 up from the recess 62, and sliding it off of the anchor pin 50.

CONCLUSION, RAMIFICATIONS AND SCOPE

Thus, it can be seen the that the paint brush case provides a simple, reliable solution to a host of problems in the field of paintbrush storage. The paint brush case is designed to accommodate equally a wide variety of brand names and styles. The paint brush case also makes it easy to transport a plurality of paint brushes while preserving their shape. The paint brush case also allows for easy identification of brushes and fast individual access to each brush. While there has been described what is at present the preferred embodiment of the invention, it will be understood that various modifications may be made therein, and it is intended to cover in the appended claims all such modifications as fall within the true spirit and scope of the invention.

Modifications may include, but are not limited to paintbrush cases of similar purpose for more or fewer paintbrushes as disclosed here. Furthermore, tray dividers may be of variable height, or not present therein whatsoever. Windows providing ventilation may be differently configured or positioned than described here. Accordingly, the scope of the present invention should be determined not by the embodiments, but by the appended claims and their legal equivalents.

We claim:

1. A paint brush case comprising:

a lid and a tray which when closed defines an enclosed box, said lid and said tray being joined together at one end for opening the lid and the tray with respect to each other;

a press mounted above said tray and a bridge mounted below said lid and aligned so that said press works cooperatively with said bridge for securing a paintbrush, said paintbrush consisting of a bristle end and a handle end with a display aperture, connected to each other by a ferule;

a means for anchoring said paintbrush by the end of said handle to said tray which facilitates rotation of said paintbrush into a plurality of positions including a horizontal position where said handle may be secured through the cooperation of said press and said bridge.

2. A paint brush case in accordance with claim 1 further including one or more dividers, mounted longitudinally in said tray adjacent to said bridge, and arranged for the purpose of segregating said paintbrushes.

3. A paint brush case in accordance with claim 1 wherein said divider supports a series of ferule grips, each positioned in a vertical orientation adjacent to said bridge.

4. A paint brush case in accordance with claim 1 further including one or more windows cut out of said tray to facilitate air drying of said bristles of said paintbrush.

5. A paint brush case in accordance with claim 1 wherein said means of anchoring the end of said paintbrush consists of one or more anchor pins protruding from one or more pin supports attached to said tray, inserting through said display aperture of said paintbrush.

6. A paintbrush case in accordance with claim 1 further including one or more pin bumpers positioned between instances of said anchor pins.

* * * * *